United States Patent [19]

Melcer

[11] 4,456,057

[45] Jun. 26, 1984

[54] SOOT BLOWER

[75] Inventor: Henryk Melcer, Seuzach, Switzerland

[73] Assignee: Sulzer Brothers Limited, Winterthur, Switzerland

[21] Appl. No.: 302,665

[22] Filed: Sep. 15, 1981

[30] Foreign Application Priority Data

Sep. 19, 1980 [CH] Switzerland ..... 7053/80

[51] Int. Cl.[3] ..... F28G 5/00

[52] U.S. Cl. ..... 165/95; 122/392; 15/316 R

[58] Field of Search ..... 165/95; 122/379, 390, 122/392; 15/318, 316 A, 317, 316 R; 239/DIG. 13, 550, 600

[56] References Cited

U.S. PATENT DOCUMENTS

| | | | |
|---|---|---|---|
| 1,155,499 | 10/1915 | Magee | 122/392 |
| 1,610,287 | 12/1926 | Hooker | 122/392 |
| 1,930,782 | 10/1933 | Turner | 122/392 |
| 1,992,336 | 2/1935 | Turner | 122/392 |
| 2,775,958 | 1/1957 | Kolling | 122/392 |
| 2,840,051 | 6/1958 | Brister et al. | 122/392 |
| 3,850,241 | 11/1974 | Hutchinson | 239/550 |

*Primary Examiner*—William R. Cline
*Assistant Examiner*—John F. McNally
*Attorney, Agent, or Firm*—Kenyon & Kenyon

[57] ABSTRACT

The soot-blower is embodied by a double tube which is disposed in a heat exchanger surface formed of straight welded-together tubes. The double tube soot-blower is formed of two concentric tubes with nozzles extending radially between and secured to the respective tubes. The inner tube is adapted to be supplied with a soot-blowing medium and the nozzles are arranged to blow the medium across the face of a heat exchanger surface or wall. The nozzles may be of one-piece construction or multi-piece construction.

3 Claims, 5 Drawing Figures

SOOT BLOWER

This invention relates to a soot blower and, more particularly, to a soot blower for a heat exchanger.

Heretofore, it has been known to construct heat exchangers with walls or heat exchanger surfaces made from welded-together tubes in order to define a chamber. In some cases, the surfaces have been formed with orifices through which soot blower lances having a soot blower nozzle at their tip can be introduced into the chamber so that steam or a high-pressure gas can be injected through the lance and nozzle to remove accumulations of soot and slag particles from the surfaces. This system has proved satisfactory in cases in which the pressure in the chamber where the deposits build up is substantially the ambient pressure. However, in other cases, complicated closure facilities must be provided for the orifices. Further, such facilities are expensive and may cause difficulties in operation. In addition, particular disadvantages arise for the case in which the heat exchanger surface is the wall of a pressure vessel or is surrounded by a pressure vessel wall.

Accordingly, it is an object of the invention to provide a soot blower which is suitable for use in a flue passage at a positive pressure of more than 10 atmospheres absolute.

It is another object of the invention to provide a soot blower for a heat exchanger which is of simple construction.

It is another object of the invention to provide a soot blower for a heat exchanger which does not require closure devices.

It is another object of the invention to provide a simple technique for blowing soot from the walls of a heat exchanger.

Briefly, the invention provides a soot blower which is comprised of a double tube including an inner tube for conveying a soot-blowing medium and an outer tube which defines an annular gap with the inner tube as well as a plurality of nozzles. Each of these nozzles is connected to the inner and outer tubes for conducting the soot-blowing medium from the inner tube out of the outer tube.

In one embodiment, each nozzle is made of one piece construction and is disposed radially of the tubes.

In another embodiment, each nozzle includes a body which is sealingly secured to each of the tubes and a hollow insert which is adjustably mounted in the body. In addition, the insert is shaped to define a constriction in order to form a jet of the soot-blowing medium during use.

The soot blower is particularly useful in a heat exchanger which has at least one heat exchange surface including a plurality of parallel tubes. In this case, the double tube of the soot-blower is incorporated in the heat exchanger surface with the annular gap between the inner and outer tubes disposed on an axis parallel to the remaining tubes of the heat exchange surface.

If the heat exchanger is constructed with a plurality of heat exchange surfaces defining a regular prism shape, each surface is provided with a double tube near a respective corner of the prism shape in order to direct a stream of soot-flowing medium along an adjacent heat exchange surface. The effect of this arrangement is that streams of soot-blowing medium graze over the adjacent heat exchanger surfaces to produce very strong scouring or removal forces.

The invention also provides a method of clearing soot from a heat exchanger having a plurality of tubes defining heat exchange surfaces. In this regard, the method is comprised of the step of alternately delivering an intensive flow of soot-blowing medium to the inner tubes of each double tube for a short period of time and a leakage flow of soot-blowing medium to the inner tubes for a longer period of time. This helps to keep the consumption of high pressure soot-blowing medium at a reasonable level while also insuring that secondary flows of dirty flue gas are not formed by the inner tubes.

These and other objects and advantages of the invention will become more apparent from the following detailed description taken in conjunction with the accompanying drawings wherein.

Figure 1:
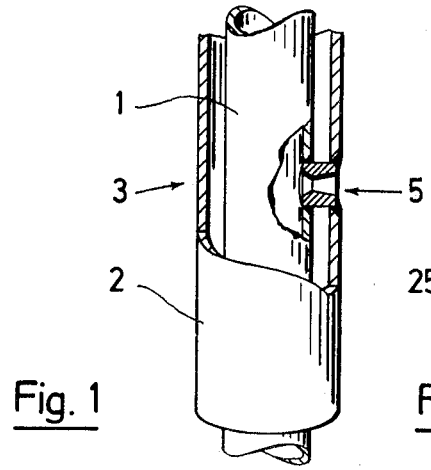
FIG. 1 illustrates a longitudinal sectional view through a double tube constructed in accordance with the invention.

Referring to FIG. 1, the soot blower is comprised of a double tube 3 which includes an inner tube 1 for conveying a soot-blowing medium and an outer tube 2 about the inner tube 1 in order to define an annular gap therebetween. In addition, a plurality of nozzles 5 are sealingly secured to and between the tubes 1, 2 in order to conduct a soot-blowing medium from the inner tube 1 out of the outer tube 2.

The inner tube 1 is provided with a plurality of apertures which are radially disposed (only one such aperture is shown) and the nozzles 5 are welded radially into the respective apertures. As shown, each nozzle 5 is of one piece construction and is in the form of a short tubular member which is turned conically at each end. For example, the entry side of the nozzle 5 adjacent the inner tube 1 is formed with a large cone apex angle while the exit side of the nozzle 5 is formed with a small cone apex angle. In addition, the nozzles 5 are sealingly secured, as by welding, to the outer tube 2.

In order to construct the double tube, the inner and outer tubes 1, 2 are placed one within the other with the inner tube 1 secured in the outer tube 2 so as to lie along a generatrix. Thereafter, the two tubes 1,2 are drilled radially. Next, the inner tube 1 is removed and the nozzles 5 welded thereto dead radially. Thereafter, the inner tube 1 with the nozzles 5 thereon is fitted into the outer tube 2 so that the nozzles 5 register with the apertures in the outer tube 2. The inner tube 1 is then raised to the required position by means of suitable tools which are introduced into the nozzles 5 radially of the tubes 1, 2 and which engage behind the nozzles 5. Thereafter, the nozzles 5 are welded to the outer tube 2.

Figure 3:
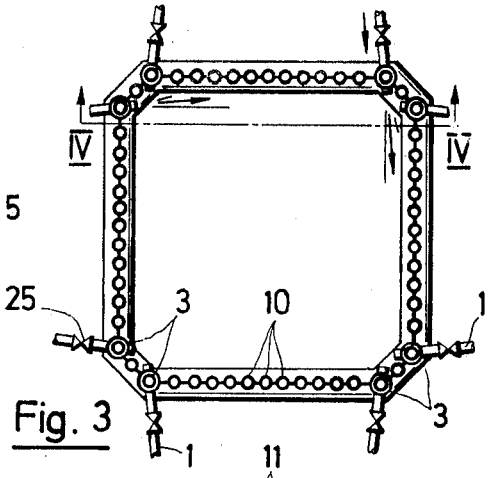
FIG. 3 illustrates a plan view through a square flue passage having a vertical axis and a plurality of soot blowers in accordance with the invention.
Figure 4:
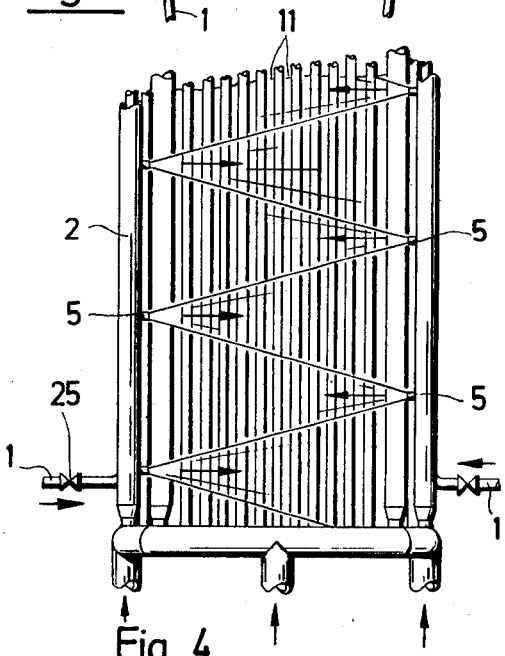
FIG. 4 illustrates a view taken on line IV—IV of FIG. 3.

Referring to FIGS. 3 and 4, the double tube soot-blowers are incorporated into a heat exchanger comprised of a plurality of heat exchange surfaces or walls formed of a plurality of parallel tubes. Generally, the heat exchanger surfaces form the walls of cooled flue passages. Each heat exchange surface is formed by parallel tubes 10 which are welded together via ribs 11 which are disposed centrally between adjacent tubes 10. The double tubes 3 are disposed in the plane of the tubes 10 near an edge between two tube walls. As indicated in FIG. 3, the heat exchange surfaces define a regular prism shape so that the double tubes are disposed near a respective corner of a prism shape. The tubes 3 are so turned that the nozzle axes are aligned substantially parallel to the adjacent wall or, at a slight angle thereto.

As shown in FIG. 4, the nozzles 5 of two oppositely disposed tubes 3 associated with the same wall plane are offset from one another so that fan-shaped zones of blown soot-blowing medium merge with one another.

Figure 2:
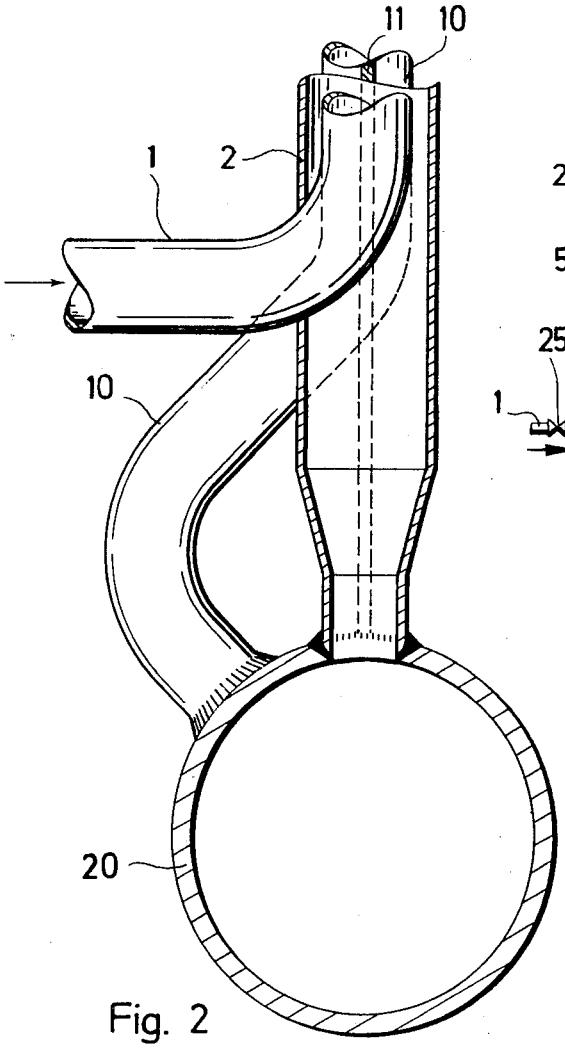
FIG. 2 illustrates a longitudinal sectional view through a double tube near a connection to a distributor of a heat exchange surface.

Referring to FIG. 2, the wall tubes 10 and the outer tubes 2 of each soot blower are connected to a distributor 20 while the inner tubes 1 extend through the respective outer tubes 2 in a bend a short distance above the distributor 20.

Each outer tube 2 is drawn in near the bottom end and is welded into an orifice in the distributor 20. The wall tubes 10 adjacent the outer tube 2 are bent in knee-fashion and are welded at an angle of approximately 45° into orifices in the distributor 20. The next adjacent wall tubes 10 extend in alternating manner in either a straight line fashion or in knee-fashion into the distributor 20.

Referring to FIG. 4, each inner tube 1 is connected via a valve 25 to a soot-blowing medium accumulator (not shown) which is charged by a compressor (not shown). This blowing medium can be, for example flue gas from the flue passage defined by the heat exchanger. Conveniently, flue gas to be used for this purpose has substantially all suspended particles therein removed before being used as a blowing medium.

Generally, the walls of the heat exchanger are cleaned in a cyclical manner. In this case, the valves 25 of the individual inner tubes 1 are briefly opened in an alternating manner.

Alternatively, the valves 25 can have a reduced leakage so that a small quantity of blowing medium continues to be supplied to the nozzles 5 even when the valves 25 are in a closed state. This leakage feature insures that, when the valves 25 are in the closed state, there is no build up in the zones between the nozzles of the tubes 1 of a secondary flow which might carry ash and particles of slag into the inner tubes 1.

Figure 5:
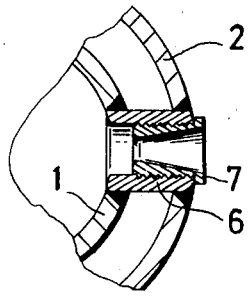
FIG. 5 illustrates a partial cross-sectional view through a soot blower tube having a modified nozzle in accordance with the invention.

Referring to FIG. 5, each nozzle may also be made of multi-piece construction. For example, each nozzle includes a body 6 in the form of a tubular member which is sealingly secured, as by welding, to and between the inner and outer tubes 1, 2. This tubular member 6 is provided with an internal screw thread and receives a hollow insert 7 in an adjustably mounted manner. As indicated, the hollow insert 7 defines a constriction to form a jet of soot-blowing medium.

The invention thus provides a soot-blower which can be incorporated into the walls of a heat exchanger. As such, there is no need to provide a means for moving soot-blowing lances into and out of the heat exchanger for cleaning purposes.

Further, the invention provides a technique for operating the soot-blowers of a heat exchanger in a manner which does not require individual closure devices for the nozzles of the soot-blowers.

A heat exchanger which has a soot-blower rigidly connected therein is particularly suitable for situations where there is a positive pressure on the gas side. In this event, complicated facilities for moving the soot-blower are unnecessary.

What is claimed is:

1. A heat exchanger comprising a plurality of heat exchange walls defining a prism shape, each said wall including a plurality of parallel tubes and ribs welded between said tubes;

a double tube disposed in each said wall in a plane of said tubes of said respective wall and near an edge at an adjacent wall, said double tube including an inner tube for conveying a soot-blowing medium and an outer tube about said inner tube to define an annular gap therebetween disposed on an axis parallel to the remaining tubes of said wall;

a plurality of nozzles in each double tube, each said nozzle being connected to said inner tube and said outer tube of a respective double tube for conducting the soot-blowing medium from said respective inner tube out of said respective outer tube across an adjacent wall; and a distributor connected to said parallel tubes and said outer tube of a respective double tube in each wall.

2. A heat exchanger as set forth in claim 1 wherein said heat exchange walls define a regular prism shape.

3. A heat exchanger as set forth in claim 2 wherein each wall has a respective double tube at each of two opposite edges and adjacent respective corners of said prism shape to direct a stream of soot-blowing medium along an adjacent heat exchange surface.

* * * * *